US011350776B2

(12) United States Patent
Liporazzi

(10) Patent No.: US 11,350,776 B2
(45) Date of Patent: Jun. 7, 2022

(54) TABLECLOTH FOR TRAYS

(71) Applicant: Fabian Dario Liporazzi, Buenos Aires (AR)

(72) Inventor: Fabian Dario Liporazzi, Buenos Aires (AR)

( * ) Notice: Subject to any disclaimer, the term of this patent is extended or adjusted under 35 U.S.C. 154(b) by 0 days.

(21) Appl. No.: 17/198,321

(22) Filed: Mar. 11, 2021

(65) Prior Publication Data

US 2022/0039571 A1 Feb. 10, 2022

(30) Foreign Application Priority Data

Aug. 4, 2020 (AR) ..... M20200102213

(51) Int. Cl.
*A47G 11/00* (2006.01)

(52) U.S. Cl.
CPC ..... *A47G 11/004* (2013.01)

(58) Field of Classification Search
CPC .. A47G 11/004; A47G 11/006; A47G 11/007; A47G 2011/005
See application file for complete search history.

(56) References Cited

U.S. PATENT DOCUMENTS

| | | | | | |
|---|---|---|---|---|---|
| 2,608,842 | A * | 9/1952 | Greene | A47G 23/0303 | 294/144 |
| 2,954,635 | A * | 10/1960 | Stotter | A47G 11/003 | 108/90 |
| 3,156,280 | A * | 11/1964 | Affholter | A47G 11/004 | 108/90 |
| 3,310,091 | A * | 3/1967 | Geisen | A47G 11/004 | 108/90 |
| 3,557,856 | A | 1/1971 | Berman | | |
| 4,617,215 | A | 10/1986 | Telesco | | |
| 5,084,321 | A | 1/1992 | Sui | | |
| 5,284,099 | A * | 2/1994 | Cohen | A47G 11/007 | 108/90 |
| 5,328,265 | A | 7/1994 | Clooney | | |
| 2011/0120360 | A1* | 5/2011 | Birdwell | A47G 11/004 | 112/475.08 |

FOREIGN PATENT DOCUMENTS

| | | | |
|---|---|---|---|
| AU | 2004100972 | A4 | 12/2004 |
| BR | 9605708-4 | A | 8/1998 |
| CH | 609547 | A5 | 3/1979 |
| DE | 3723277 | A1 | 2/1988 |
| DE | 102006014539 | A1 | 11/2006 |
| FR | 2197547 | | 3/1974 |
| FR | 2299836 | A1 | 9/1976 |
| FR | 2760618 | | 9/1998 |
| GB | 862179 | | 3/1961 |

* cited by examiner

*Primary Examiner* — Matthew W Ing
(74) *Attorney, Agent, or Firm* — Jerold I. Schneider

(57) ABSTRACT

A paper mat (1) for fast food trays, includes a central area (9) and, at both side ends, at least three and at most four folding areas (5, 6, 7, 8, 10, 11, 12, 13) defined and divided from each other and regarding such central area (9) by parallel folding lines (2), each of such folding areas matching the contour shape of the side end of such trays, fully mimicking such shape in order to completely cover each of such respective areas below each folding area, such mat fully fitting the ends of such tray.

10 Claims, 7 Drawing Sheets

TABLECLOTH FOR TRAYS

The present invention, as expressed in the statement of this descriptive memory refers a new tablecloth for fast food trays (belonging to food court, diners, airplanes or trains, which has been designed and made in order to obtain notablecloth advantages in the hygienic, practical and economic order, regarding other existing means of analogue purposes. The design is intended to guarantee hygiene and not contamination of the users hands, in the transport of the tray.

For many years and more today, the habit of consumption of the so-called fast foods. In establishments for such purpose, it is very common to deliver trays for customers to bring their foods to the tablecloths.

Once used, the user empts them into a basket and supports them on the furniture containing such basket, generating a pile of them, or a person from the establishment comes to perform that function.

In some cases, they are cleaned with a cloth that go with a spray cleaner, the same as they use for the tablecloths. It is a surface cleaning and where, above all, they seek to remove the remains of food and dressings that are found in the trays.

Food court trays for example of shoppings are gathered by cleaning staff and distributed by food locals.

The trays are one of the main points of contamination and transmission of viruses, bacteria and germs.

The diner, when carrying the trays, grasps the handles of the same, which are the part that is less dirty with food and the less considered in cleaning, but it is the main focus of transmission.

Despite de fact that the trays are delivered with a tablecloth (an advertising and hygiene element where food, bread, sorbets, covered, etc. are supported), the handles of the same are uncovered, contaminating the hands that the user will immediately use whether to take the cutlery, the glass, to open the wrapping of a burger, or to grip the food directly, such as French fries, onion rings, etc.

When you buy a fast-food menu, everything is personal (the food, the utensils, the tablecloth), except the tray which is the only thing that is reused.

Similar situations occur with trays on trains, airplanes and diners, among others.

The present invention solves these disadvantages, through the continuity of the tablecloths, which fit in the handles of the trays.

In this way, the user never touches the tray, avoiding contamination.

A simple solution, totally hygienic, easy to manufacture and very economic.

There are many patents of tablecloths, for example the patent: PI9605708-4A, with different front flags that fold to see the menu; the patent: FR2197547 that has different removable dies for the menu; the patent: FR2299836 (A1), with advertising dies for products; the patent: FR2760618 (A1), with dies on the edges, the patent: AU2004100972A4; the patent: ES1053560 (U) which consists of a bag for the transportation of prepared food carrying tablecloths in its structure; the patent: ES2450792 (A1), which consists of a matel with cuts for put napkins, covers, etc; and finally the patent: MXPA04009595 (A), which consists of a bag transformable in tablecloth.

But no one gives answer to the situation posed at a beginning.

My other patent application, 20200101549, perfectly solves this problematic, with different variants.

Although the present invention has as final result the coverage of the handles with the tablecloth, by extending the same (longitudinally as in my previous application), it gives a variant in part of its manufacturing, making it simple, economic and very easy to install, optimizing the stacking and packaging of the tablecloths.

The disadvantages described have been solved through this invention, consisting of a disposable paper, plastic, fabric, or materials intended for this purpose, with different finishes, advertisements, promotions, scratches or keyboards, among others.

Said tablecloth has a continuity in a longitudinal sense, where it goes generating premarked folding lines or weaknesses that serve to copy the shape of the tray, covering each handle in its entirety, bottom and above.

Another option is that they also cover the thicknesses of the longitudinal direction of the trays, or that it exceeds one or the two edges of the same, generating also, a very important information or publicity space.

In order that the utility model is clearly interpreted and taken to the practice with ease, the illustrative drawings have been presented accompany this memory, in which.

Figure 1:
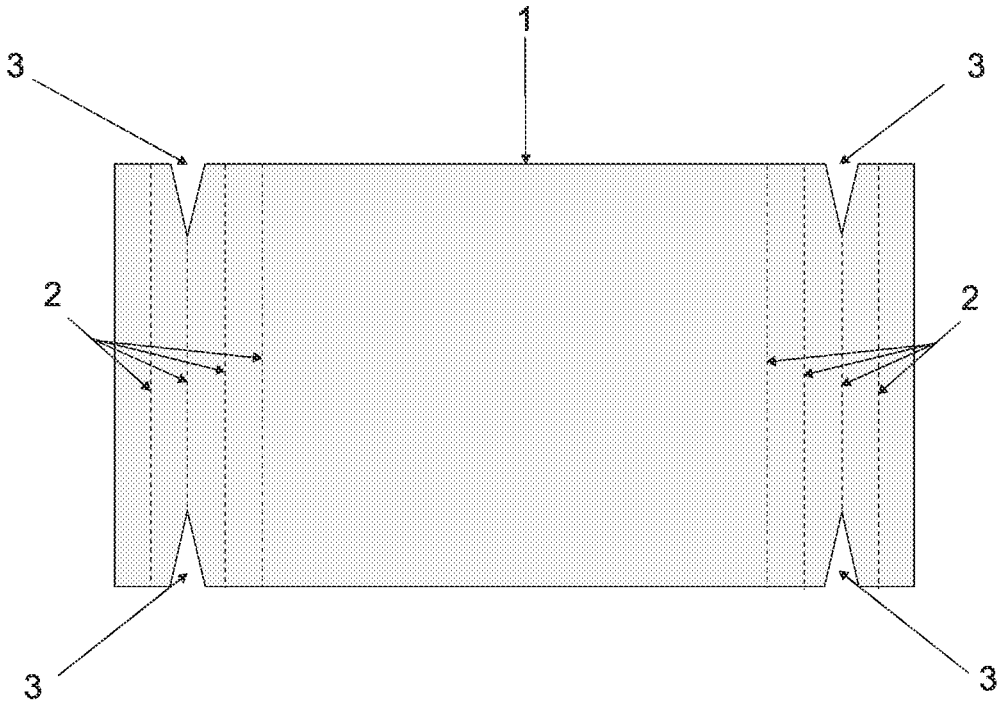
FIG. 1 is a top view of the tablecloth.

In FIG. 1 we see a top view of the tablecloth (1), with perforated folding lines (2) and with four drawings (3) that copy the shape of the diagonals from the tray.

Figure 2:
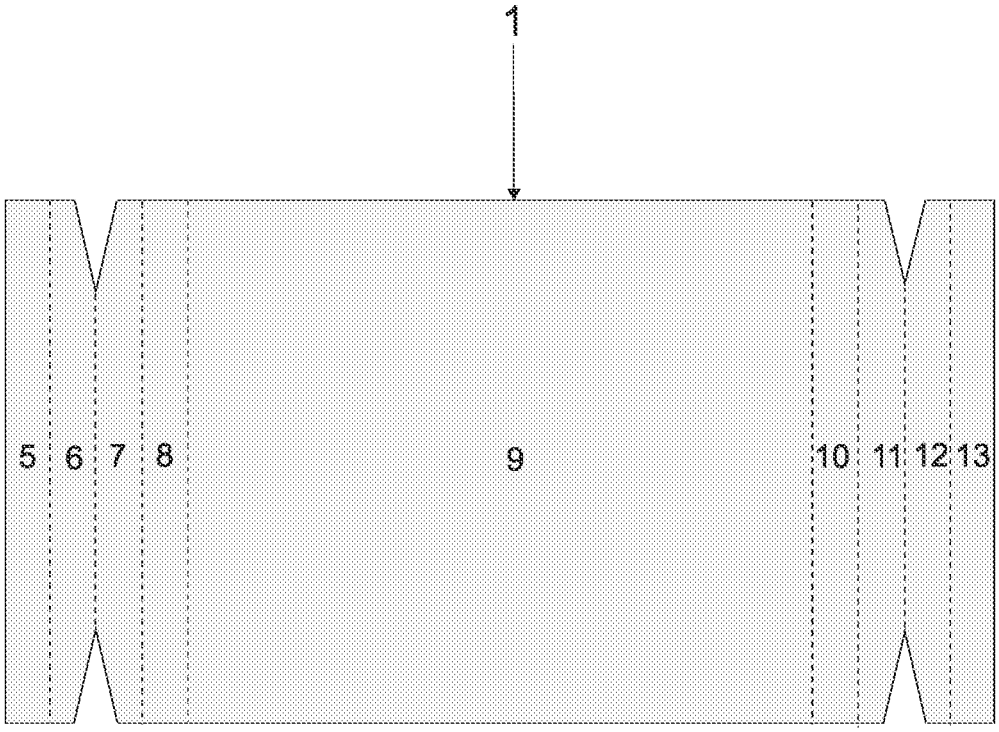
FIG. 2 is a top view of the tablecloth, and a longitudinal cut of the tablecloth placed on the tray.
Figure 2:
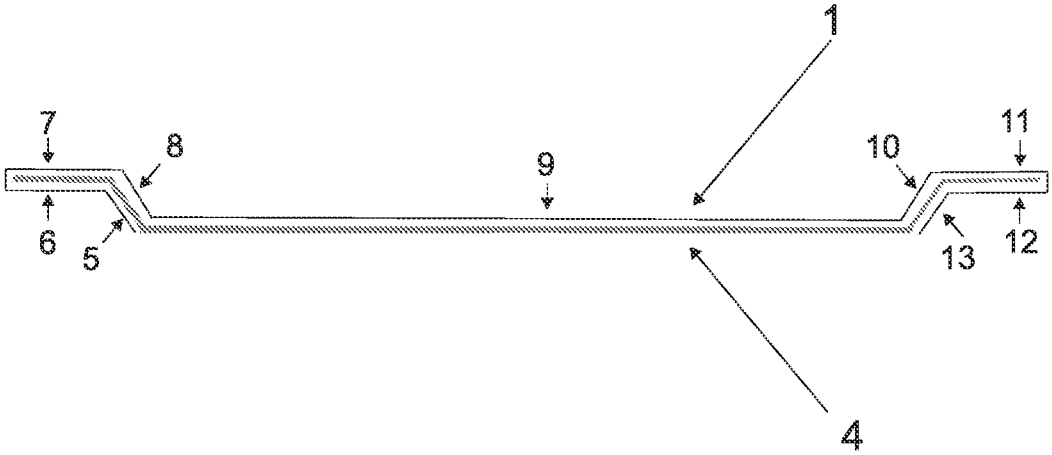

In FIG. 2 is a top view of the tablecloth (1), where we see the surfaces (5), (6), (7), (8), (9), (10), (11), (12) and (13) that are separated by the lines perforated for folding. Such surfaces will be arranged as seen in the longitudinal cutting of the tablecloth placed in the tray (4).

Figure 3:
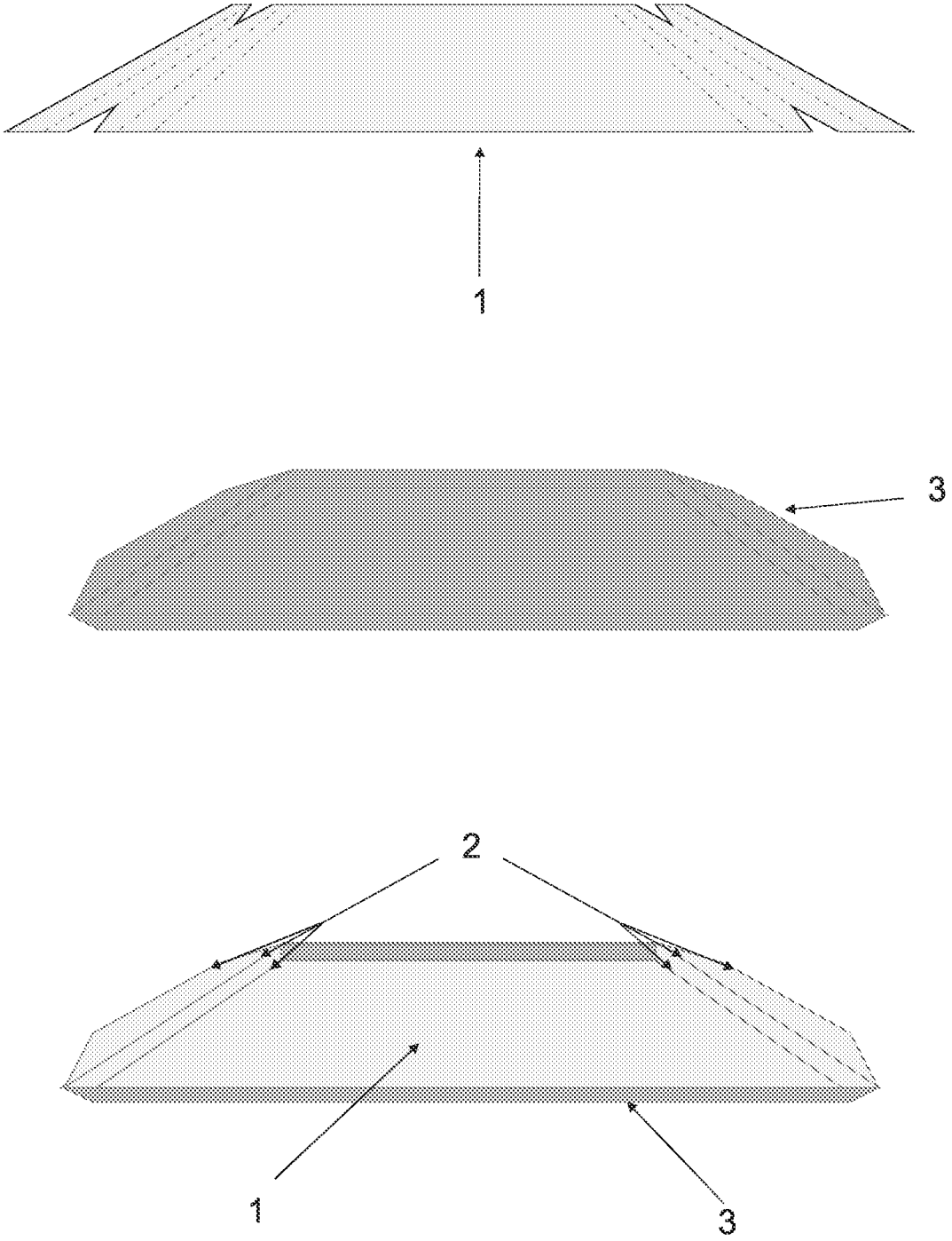
FIG. 3 is a perspective of the tablecloth, the tray, and the tray with the handle protective tablecloth.

In FIG. 3 we see a perspective of the tablecloth (1), the tray (3), and the tray (3) in FIG. 3 we see a perspective of the tablecloth (1), the tray (3), and the tray (3) with the handle protective cover (1) placed, where the fold lines were observed.

Figure 4:
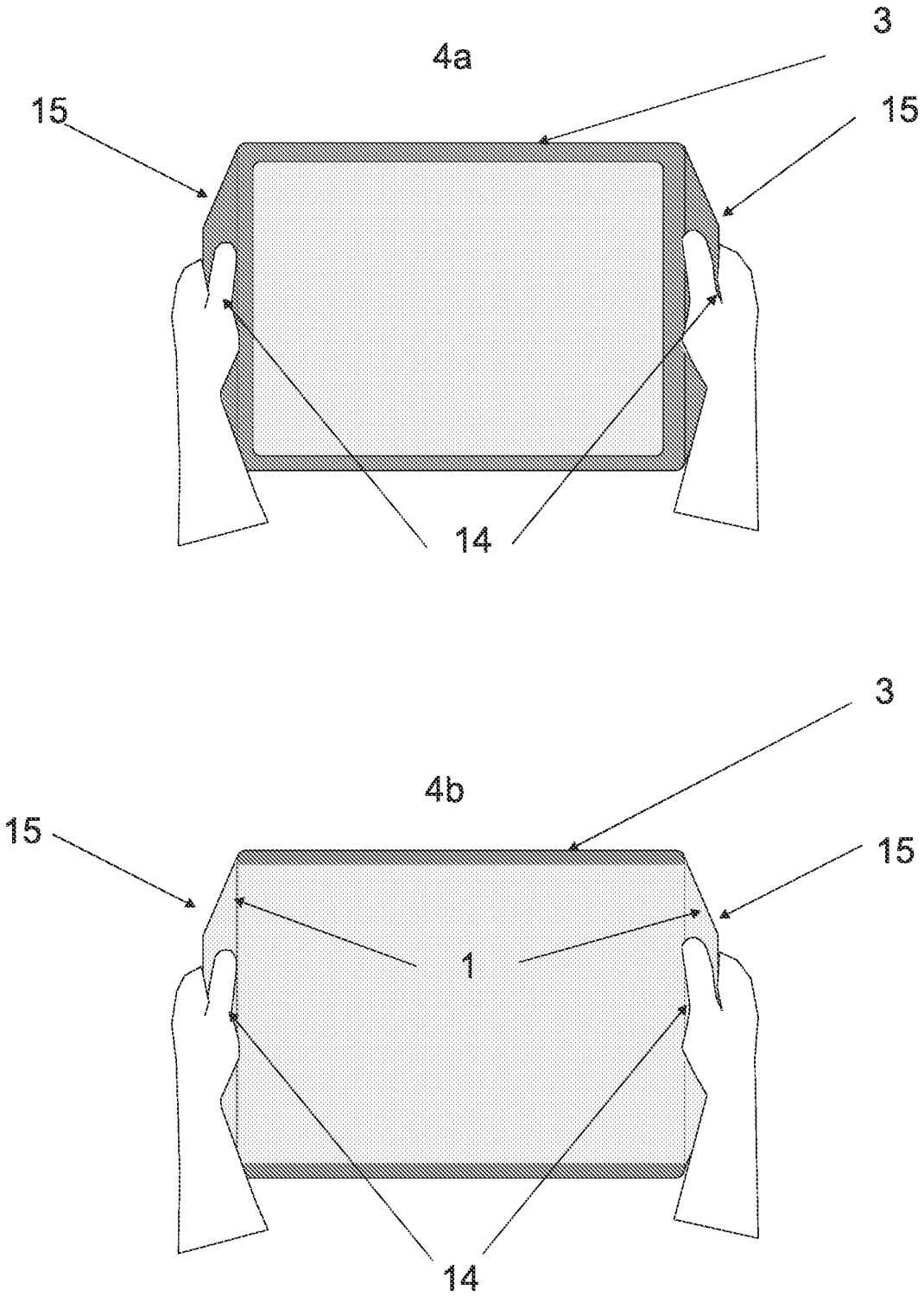
FIG. 4 is a top view of the tray with a conventional tablecloth and with the handle protective tablecloth.

In FIG. 4 we have a top view (4*a*) of the tray (3) with a conventional tablecloth, and we see how the user's hands (14) grip the handles (15) of the tray (3) without any kind of protection. We also have a top view (4*b*) of the tray (3) with the new tablecloth, and we see how the user's hands (14) grip the handles (15) of the tray (3) with protection.

Figure 5:
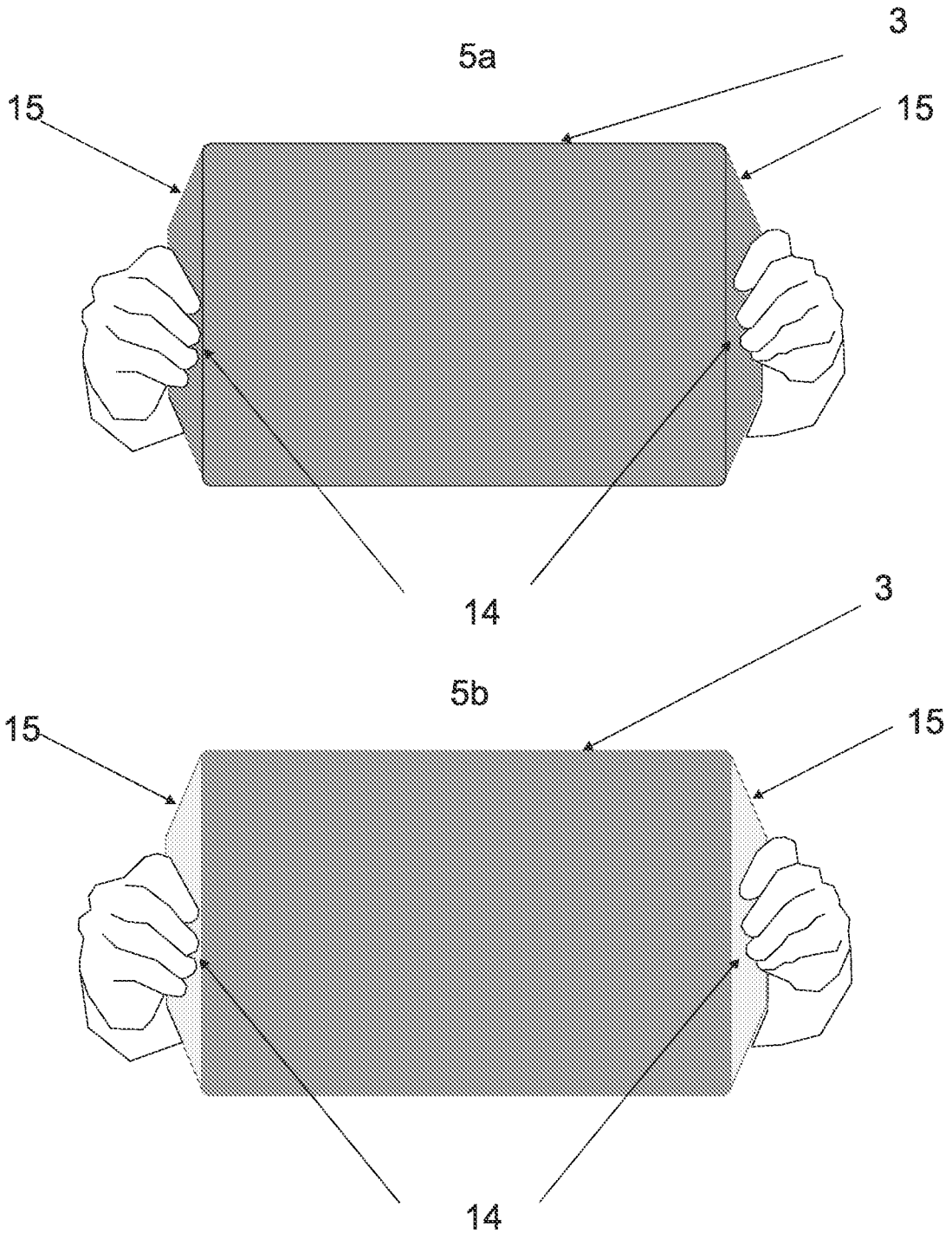
FIG. 5 is a bottom view of the tray with a conventional tablecloth and with the handle protective tablecloth.

In FIG. 5 we have a bottom view (4*a*) of the tray (3) with a conventional tablecloth, and we see how the user's hands (14) grip the handles (15) of the tray (3) without any kind of protection. We also have a bottom view (4*b*) of the tray (3) with the new tablecloth, and we see how the user's hands (14) grip the handles (15) of the tray (3) with protection.

Figure 6:
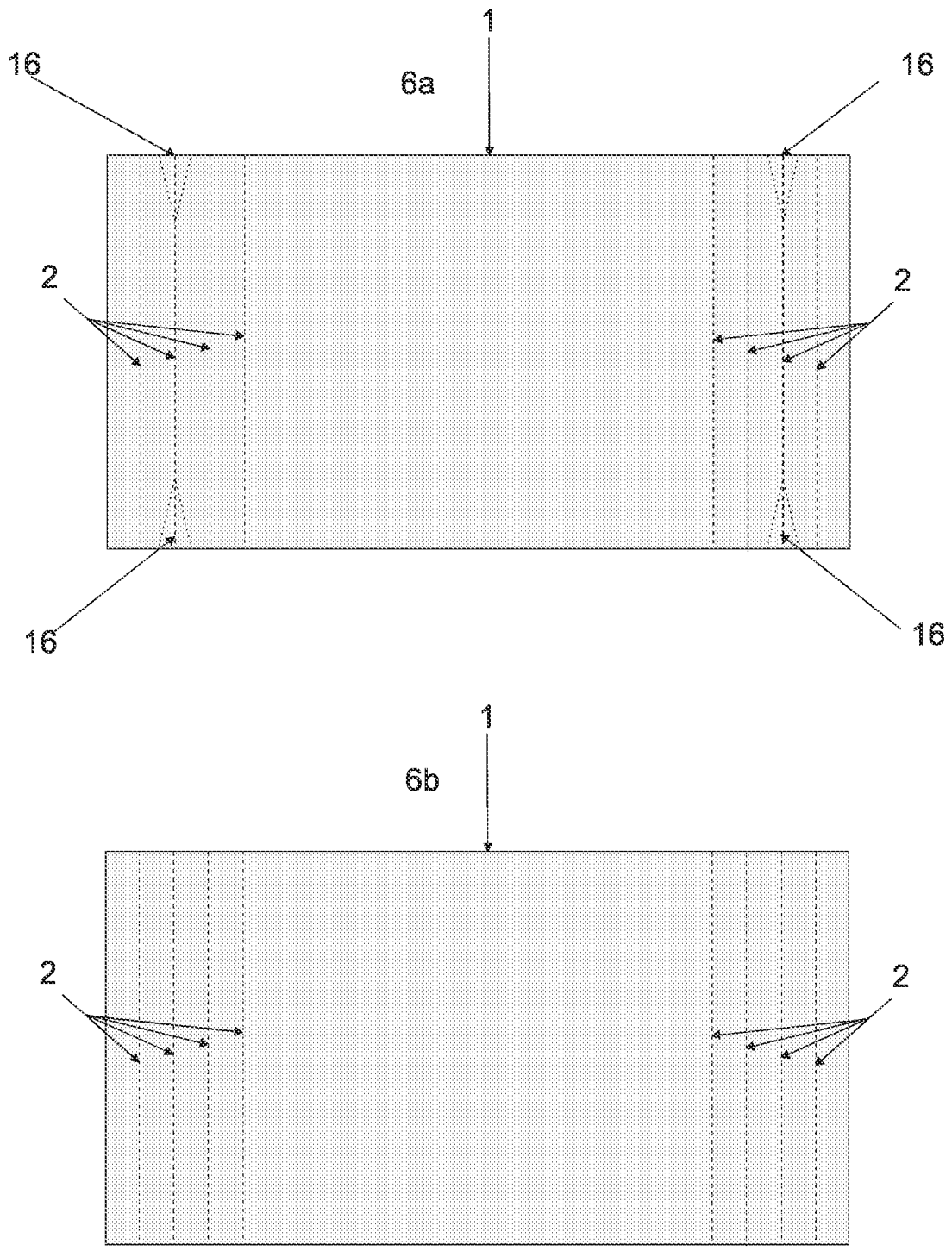
FIG. 6 shows a tablecloth variant with weaknesses to fold the triangles and a complete rectangle that does not mark the handles diagonals.

In FIG. 6 we have a top view (6*a*) of the tablecloth (1), where they are found in the form of a triangle, 4 sectors (16) (all with weaknesses on their edges), that folds and take the shape of the diagonals of the handles of the trays. We also have a top view (6*b*) of the tablecloth (1), where the lines of weakening (2) separate the surfaces which don't copy the diagonals of the tray handles.

Figure 7:
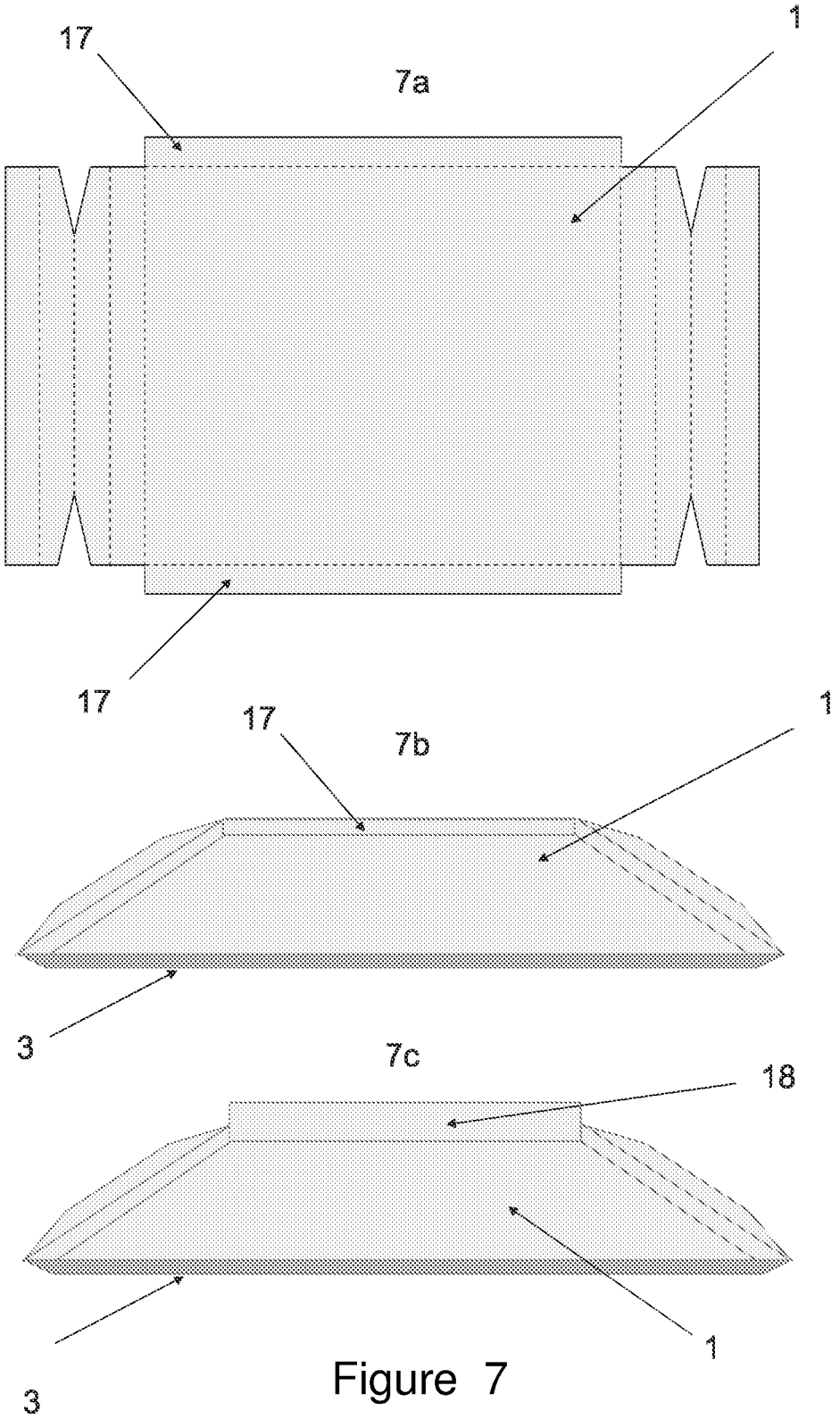
FIG. 7 shows a variant of the tablecloth covering the four edges of depth of the tray, being able (the longitudinal edges) to exceed the width of themselves.

In FIG. 7 we have a top view (7*a*) of the new tablecloth (1), with the aggregate of two surfaces (17) that covers the four edges of the depth of the tray, as seen in the perspective of FIG. 7*b*).

In FIG. 7*c*) you see one of the longitudinal edges (18), where there may be a surface in the two that exceeds the edge width, achieving in addition to the hygienic part, a sport for very important information or publicity.

The invention claimed is:

1. A paper mat (1) for fast food trays, characterized in that it comprises a central area (9) and, at both side ends, at least three and at most four folding areas (5, 6, 7, 8, 10, 11, 12, 13) defined and divided from one another and regarding such central area (9) by parallel folding lines (2), matching each of such folding areas with the contour shape of the side end of such trays, fully mimicking such contour so as to completely cover each of such respective areas below each folding area, such mat fully fitting the side ends of such tray.

2. The paper mat according to claim 1, characterized in that it further comprises, between the second and the third folding areas (6, 7; 11, 12) considered from such central area (9), skew folding lines (3) intersecting at a point that is part of the parallel folding line dividing such second and third folding areas (6, 7; 11, 12), which defines an additional folding area, in order to mimic the contour of a tray with a curved or straight trapezoidal shape.

3. The paper mat according to claim 1, characterized in that it further comprises, on one or both longitudinal ends of such central area (9), at least one and at most two folding areas (18) divided from one another and regarding such central area (9) by at least one and at most two longitudinal folding lines (17).

4. The paper mat according to claim 3, characterized in that if it comprises on such one or both longitudinal ends of such central area (9) a single folding area (18), such single folding area fully or partially mimics the area of the tray therebelow.

5. The paper mat according to claim 3, characterized in that if it comprises, on such one or both longitudinal ends of such central area (9), a single folding area (18) on one of such longitudinal ends and two folding areas (18) on the other longitudinal end, such single folding area fully or partially mimics the area of the tray therebelow, and such two folding areas on such other longitudinal end fully mimics the area of the tray therebelow, such mat fitting such tray.

6. The paper mat according to claim 3, characterized in that if it comprises, on both longitudinal ends of such central area (9) two folding areas (18), each of such folding areas fully mimics the side contour shape of such tray in order to cover each of such respective areas below each of such two folding areas, such mat fitting such tray.

7. The paper mat according to claim 1, characterized in that the contour shape of such tray forms gripping regions for the user, both at the side ends and at the longitudinal ends of such trays, as well.

8. The paper mat according to claim 1, characterized in that such folding lines are printed, weakened or die-cut lines, or the like.

9. The paper mat according to claim 1, characterized in that it remains fully fit in such trays when in use.

10. The paper mat according to claim 1, characterized in that each of such folding areas has a smaller surface than such central area.

* * * * *